US007338198B2

(12) United States Patent
Nesbitt et al.

(10) Patent No.: US 7,338,198 B2
(45) Date of Patent: Mar. 4, 2008

(54) STIRRING DEVICE AND METHOD FOR MEASURING A PARAMETER OF A SUBSTANCE TO BE STIRRED

(75) Inventors: Geoffrey John Nesbitt, Bennekom (NL); Emilio René Bodenstaff, Delft (NL)

(73) Assignee: Mettler-Toledo AG (CH)

( * ) Notice: Subject to any disclaimer, the term of this patent is extended or adjusted under 35 U.S.C. 154(b) by 382 days.

(21) Appl. No.: 10/472,881

(22) PCT Filed: Mar. 22, 2002

(86) PCT No.: PCT/EP02/03343

§ 371 (c)(1),
(2), (4) Date: Mar. 26, 2004

(87) PCT Pub. No.: WO02/076595

PCT Pub. Date: Oct. 3, 2002

(65) Prior Publication Data

US 2004/0165474 A1 Aug. 26, 2004

(30) Foreign Application Priority Data

Mar. 22, 2001 (EP) ..... 01201096

(51) Int. Cl.
*B01F 13/08* (2006.01)
*B01F 15/00* (2006.01)

(52) U.S. Cl. ..... 366/142; 366/273; 366/343

(58) Field of Classification Search ..... 366/273, 366/274, 343, 142; 73/54.01
See application file for complete search history.

(56) References Cited

U.S. PATENT DOCUMENTS

| | | | | |
|---|---|---|---|---|
| 3,758,845 | A | 9/1973 | MacKelvie et al. | |
| 4,042,219 | A | 8/1977 | Terry | |
| 5,120,135 | A * | 6/1992 | Ullman | 366/273 |
| 5,691,687 | A | 11/1997 | Kumagai et al. | |
| 5,814,900 | A | 9/1998 | Esser et al. | |
| 6,065,865 | A | 5/2000 | Eyraud et al. | |
| 6,149,295 | A * | 11/2000 | Volkmer et al. | 366/142 |
| 6,432,706 | B1 * | 8/2002 | Hudson et al. | 435/325 |
| 7,140,239 | B2 * | 11/2006 | Greenwood et al. | 73/61.63 |
| 2005/0182342 | A1 * | 8/2005 | Dinsmoor et al. | 600/593 |

FOREIGN PATENT DOCUMENTS

| | | |
|---|---|---|
| DE | 33 22 409 A1 | 1/1985 |
| DE | 42 01 693 C1 | 4/1993 |
| DE | 44 23 848 A1 | 7/1994 |

(Continued)

*Primary Examiner*—Tony G Soohoo
(74) *Attorney, Agent, or Firm*—Hoffman & Baron, LLP

(57) ABSTRACT

A stirrer for stirring a substance, the stirrer comprising a stirring device and a powering device, the stirring device being adapted to be submerged in the substance for making a stirring movement, the powering device by a first field contactlessly applying a force onto the stirring device for powering the stirring movement of the stirring device, whereby the stirring device comprises a sensing device for measuring at least one parameter of the substance. Further, the invention comprises a stirring device for use in such stirrer, a stirring apparatus and a module for measuring a parameter of a substance surrounding the module. Still further, the invention comprises a use of such stirring device and a method for measuring a parameter of a substance being stirred by a stirring device.

31 Claims, 6 Drawing Sheets

FOREIGN PATENT DOCUMENTS

| | | |
|---|---|---|
| DE | 44 40 250 A1 | 5/1996 |
| EP | 0 988 888 A1 | 3/2000 |
| JP | 63012936 | 1/1988 |
| JP | 63151342 | 6/1988 |
| JP | 02139024 | 5/1990 |
| JP | 2000124030 | 4/2000 |
| WO | WO 98/52350 | 11/1998 |

* cited by examiner

STIRRING DEVICE AND METHOD FOR MEASURING A PARAMETER OF A SUBSTANCE TO BE STIRRED

CROSS-REFERENCE TO RELATED APPLICATIONS

This application is the national stage filing under 35 U.S.C. § 371 of PCT/EP02/03343, filed Mar. 22, 2002, which claims priority to EP 01201096.3, filed Mar. 22, 2001, which is incorporated herein by reference.

FIELD OF THE INVENTION

The invention relates to a stirrer for stirring a substance, the stirrer comprising a stirring device and a powering device, the stirring device being adapted to be submerged in the substance for making a stirring movement, the powering device by a first field contactlessly applying a force onto the stirring device for powering the stirring movement of the stirring device. Further, the invention relates to a stirring device for use in a stirrer. Further, the invention relates to a stirring apparatus. Further, the invention relates to a module for measuring a parameter of a substance surrounding the module, the module comprising a sensing device for measuring the parameter of the substance, a reception device, coupled to the sensing device, for remote coupling of energy into the reception device, and a transmitting device, coupled to the sensing device, for transmitting at least one measurement from the sensing device to a receiver, the reception device comprising a reception coil for the inductive coupling of energy into the reception device, the transmitting device comprising a transmitting coil. Still further, the invention relates to the use of a stirring device. Again still further, the invention relates to a method for measuring a parameter of a substance being stirred by a stirring device being submerged in the substance and making a stirring movement, the stirring movement of the stirring device being contactlessly powered by applying a force onto the stirring device by a first field.

BACKGROUND OF THE INVENTION

Stirrers for stirring a substance, such as a fluid or granular material comprised in a vessel, are used in a wide range of applications. These applications comprise performing chemical or biochemical tests and experiments in research, laboratories, hospitals etc. The stirrers comprise a stirring device, which is submerged in the substance and which can have all kind of shapes, depending on the characteristics of the substance. Traditionally, a capsule-shaped or bean-shaped stirring device is widely used, but many new designs are available to improve stirring torque and efficiency. The stirrer conventionally comprises a powering device for contactlessly, e.g. magnetically powering the stirring device, In a stirring application, there is often a need to measure one or more parameters related to the substance to be stirred. These parameters may comprise all kinds of quantities, such as physical or chemical quantities. Some common examples of such parameters are a temperature or an acidity.

A known solution is to measure these parameters making use of one or more measurement instruments. The instrument is equipped with a separate or built-in sensing probe which is positioned in the substance. A disadvantage is that mechanical collisions might occur in the substance between the stirring device, which is making a stirring movement, and the sensing probe or an other part of a measurement instrument. An other major disadvantage is that the presence of the probe will have an influence on the process or processes taking place in the substance. The physical presence of the probe can, for example in case that the parameter is a temperature, have a direct influence on the temperature of the substance itself by means of the mass and temperature of the probe, or have an indirect influence, such as disturbing a temperature dependent chemical reaction, by a local or global change in the temperature of the substance because of the presence of the probe.

A known solution to overcome the above disadvantages when using a measurement instrument is to position the probe outside of the substance. This however has a disadvantage of a lower accuracy, because of the physical distance between the probe and the substance. Also a disadvantage is that it is not able to detect processes that are taking place inside the substance. Again making use of the example that the parameter is a temperature, chemical reactions comprise so called endothermic and exothermic reactions. By measuring a temperature of a substance using a probe which is positioned outside the substance, local temperature changes inside the substance can hardly be detected, making it difficult to monitor from outside of the substance if, and to what extent, reactions are taking place.

The above disadvantages especially arise in high-speed experimentation equipment, which is e.g. used in petrochemical and pharmaceutical industries. High-speed experimentation equipment comprises a number of units, in which reactions can take place. By varying initial conditions for these reactions, optimal conditions can be quickly identified by performing a number of experiments in parallel. To be able to achieve a high time-efficiency in performing these experiments, so called blocks are known, which comprise a large amount of similar or identical units, each provided with many functions, such as stirring, heating and cooling. Because of the requirements to quickly as well as accurately perform a large amount of reactions, and at the same time accurately measure one or more parameters for evaluation and selection, the requirements for accurate and reliable measurements are high and can hardly be met when making use of the above solutions.

OBJECTS OF THE INVENTION

An object of the invention is to remove the drawbacks of the prior art. A further object of the invention is to increase the accuracy of a measurement of a parameter. A still further object of the invention is to simplify use and handling, thus increasing efficiency in performing experiments or tests.

SUMMARY OF THE INVENTION

To achieve these and other goals, the stirring device according to the invention is characterised in that the stirring device comprises a sensing device for measuring at least one parameter of the substance. When the sensing device is comprised in the stirring device, no further probe or other parts of a measurement instrument need to be placed in the substance. Therefore, no disturbing effects because of the presence of a part of a measurement instrument can occur. Also, a risk for mechanical collision of the stirring device against a probe or other part of the measurement instrument is avoided. Further, this feature allows to place the sensing device as close as possible to the substance, and especially to that part of the substance, which is stirred at that particular moment in time, resulting in an optimum accuracy and direct capture of any, even minimal, changes in the parameter, because the sensing device is positioned close to the places in the substance, where the chemical and/or physical changes are taking place.

The at least one parameter of the substance can comprise a temperature and the sensing device can comprise a temperature sensor, such as a silicon integrated circuit sensor, a resistor having a temperature dependent resistance, or a resonance device having at least one temperature dependent resonance parameter. Also, the at least one parameter of the substance can comprise an acidity, a viscosity or any other parameter. Also it is possible for the stirring device to measure multiple, possibly different parameters, or to measure the same or different parameters at different parts of the stirring device.

Advantageously, the first field is a magnetic or electromagnetic field, while the stirring device comprises a magnetic device. In this case the powering device advantageously comprises a rotating magnet and the first field is a rotating field. Also, the powering device can advantageously comprise a plurality of electromagnets which are supplied with electrical current for creating a stirring movement of the stirring device, i.e. for generating a non-static magnetic field. The use of a magnetic field and a powering device comprising a rotating magnet or a plurality of electromagnets offers a simple, proven solution with a minimum interference to the processes taking place in the substance. The plurality of electromagnets can be sequentially supplied with electrical current in any suitable pattern, including patterns in which multiple electromagnets are supplied simultaneously with currents of equal or different value.

Advantageously, the stirring device comprises a reception device, coupled to the sensing device, for remote coupling of energy into the reception device. This allows for remotely, and therefore contactlessly and thus without any interferences on the chemical or physical processes taking place in the substance, supplying energy to the reception device. Also, this avoids the need to periodically exchange or charge a power source, such as a battery, comprised in the stirring device, which could interfere with planning schedules, in case that tests need to be performed while batteries appear to be empty and need replacement or recharging. Furthermore batteries have a limited temperature range, limiting the temperature range of a stirring device which is battery powered.

Advantageously, the remote coupling of energy is provided by a second field, which can be an electromagnetic field, while advantageouly the coupling is an inductive coupling. The use of an electromagnetic field allows a contactless and reliable transmitting of energy, which normally does not interfere with the processes taking place in the substance. Furthermore, as, as described above, advantageously the first field also comprises an electromagnetic field, synergy effects can occur, apart for the advantages of an electromagnetic field per se, resulting in multiple use of components for both fields, and low manufacturing costs. Also other solutions are possible, such as capacitive coupling of energy.

Advantageously the reception device comprises a reception coil, which reception coil can advantageously be wound around a longitudinal or transverse axis of the stirring device. This provides a simple, cost effective, way of receiving the energy supplied by the second field, which has a high power efficiency. Due to the distance between the stirring device and a transmitting device, which transmits the field, due to the attenuation caused by the substance itself and by a container or vessel comprising the substance, and due to the geometrical uncertain position of the stirring device, which is making a stirring, and often a rotating, movement, the total attenuation of the electromagnetic field is high. A reception coil, advantageously wound around a longitudinal or transverse axis of the stirring device, provides high efficiency, allowing for receiving a sufficient amount of energy, despite the high attenuation, while maintaining a small volume and low mass of the stirring device.

Advantageously the electromagnetic field has a frequency in the range of 1 to 100 kHz. This allows for bringing together conflicting requirements, such as the allowable attenuation of the electromagnetic field due to a wall of a container or vessel in which the substance can be comprised, the maximum dimensions and mass of the stirring device, and the size of electronic components, in particular the size of an electrical capacitor for filtering and storing the electromagnetic energy and/or signal received in the stirring device.

Advantageously the stirring device comprises a transmitting device, coupled to the sensing device for transmitting (data relating to) at least one measurement from the stirring device to a receiver, which is positioned outside the substance to be stirred. By transmitting (data relating to) one or more measurements from the stirring device to a receiver, it is possible to instantaneously read out the measurement result. Also other solutions are possible. The at least one measurement and related data can be stored in a memory comprised in the stirring device, in which case the memory can be read out later.

Advantageously, the transmitting device comprises a transmitting coil, where in particular the transmitting coil is the reception coil. This allows an extremely simple, effective, and mechanically compact setup, which reuses the coil, being a critical component for a large part determining the size and mass of the stirring device.

Advantageously, the transmitting device modulates an impedance of the reception coil or the reception device comprises a detection device, for detecting if power is received momentarily, and the transmitting device is enabled to transmit (data relating to) at least one measurement when the detection device detects that no energy is received momentarily. A modulation of the impedance of the coil can be detected at the transmit side, which allows the second field to perform a double function: it not only transmits energy to the stirring device, but also transfers information back, advantageously by modulating an impedance of the reception coil. Alternatively, measurements can be transmitted during time slots when the coil does not receive energy. Any other applicable modulation or multiplexing method can be applied also in the transmission of data.

Advantageously, the measuring of the at least one parameter is performed repeatedly, advantageously with an essentially, or substantially constant time interval between successive measurements. By repeatedly, or advantageously periodically performing a measurement of the parameter of the substance, it is possible to precisely monitor the process taking place in the substance. Especially in combination with the above mentioned advantages of accuracy and minimal disturbance of the process taking place in the substance, a versatile and easy to use measurement tool is implemented, which can monitor the change of a parameter during a process, such as a chemical reaction, while minimally interfering with the process taking place. Also it is possible to perform continuous measurements or only a single measurement.

Advantageously, the stirring device has a maximum dimension of 10 mm, but other dimensions are also possible. Advantageously, the stirring device is disk-, capsule- or longitudinally shaped.

The stirring device can comprise an encapsulation comprising glass, epoxy or PTFE. These materials are especially advantageous, because they provide a high chemical inertia, while offering a low attenuation factor for any magnetic and electromagnetic fields involved.

Further, the invention comprises a stirring device for use in a stirrer as described above, the stirring device comprising a sensing device for measuring at least a parameter of the substance.

Further, the invention comprises a stirring apparatus comprising a stirrer as described above and a vessel for comprising the substance.

Advantageously, the stirring apparatus comprises a receiver device comprising receiver means for receiving measurement data transmitted by the stirring device and readout means for transmitting the measurement data to a read out device, which allows for a user-friendly readout.

Further, the invention comprises a module for measuring a parameter of a substance surrounding the module, characterised in that the transmitting coil is the reception coil, the reception device comprising a detection device for detecting if energy is received momentarily, and the transmitting device being adapted to transmit the at least one measurement when the detection device detects that no energy is received momentarily. This allows for using a coil in the module for dual purpose, it is used to receive energy, and during the time periods when no field transferring energy is transmitted, the same coil is used to transmit information from the module to a remote receiver.

Also the invention comprises a module for measuring a parameter of a substance surrounding the module, characterised in that the transmitting coil is the reception coil and the transmitting coil is coupled to an impedance modulator for modulating an impedance of the transmitting coil. This module also allows a compact unit to be realised, which combines the coil for receiving energy and the coil for transmitting information to a remote receiver into one coil, thus realising a compact unit.

The modules according to the invention can be comprised in a stirring device. The module can however also be used in numerous applications, where measurements have to be performed with a unit having small dimensions, providing minimum interference in the process taking place and/or allowing measurement of a parameter making use of a small sized module, which can be read-out remotely. Applications such as medical, industrial, veterinary, automotive and numerous other applications with various sizes of modules are possible.

The module can advantageously be used for temperature measurement, when the sensing device comprises a temperature sensor. The temperature sensor can comprise a silicon integrated circuit sensor, a resistor having a temperature dependent resistance or a resonance device having at least a temperature dependent resonance parameter.

Further, the invention comprises a use of a stirring device according to the invention for stirring a substance and a use of a stirring device according to the invention for measuring a parameter of the substance.

Still further, the invention comprises a method for measuring a parameter of a substance, comprising the step of measuring the parameter with a sensing device comprised in the stirring device.

Advantageously, the method comprises the step of powering the sensing device with a second field, and advantageously, the method comprises the step of contactlessly transmitting at least a measurement from the stirring device to a receiver.

Advantageously, the stirring device comprises an electromagnetic device and the reception device comprises at least one generator coil or part thereof for generating electrical energy, the generator coil or part thereof being positioned asymmetrically with regard to a centre between a first magnetic pole and an opposite, second magnetic pole of the magnetic device. This allows to generate electrical energy, such as a voltage or a current, in the stirring device by making use of the first field, thus making use of the same field that is used for powering the stirring movement of the stirring device. Both the stirring device and the first field make a stirring movement, such as a rotating movement, causing the position of the stirring device to be substantially in synchronism with the first field. In case the first field is a uniformly rotating field (such as generated by a rotating magnet) the stirring device will rotate substantially synchronously with the field. In case that the first field is a stepwise changing field (such as generated by a plurality of electromagnets which are driven by a plurality of electric currents in a substantially sequential way), the stirring device will in average follow the field, however, a time and position dependent difference will exist as the substantially uniformly rotating stirring device follows a first field which changes sequentially or step-wise. As the stirring device is basically 'following' the stepwise or uniform rotational movement of the first field, it is expected that the stirring device will experience little changes in the field. Now, in case that the generation coil is positioned asymmetrically on the magnetic device located in the stirring device, the generation coil will be subject to an alternating magnetic or electromagnetic field. To accomplish this, the at least one generator coil is required to be mounted with regard to the magnetic device located in the stirring device in an asymmetric way, i.e. the generator coil should be positioned asymmetrically with regard to a centre between the first magnetic pole and the second, opposite magnetic pole of the magnetic device. As the centre between the first and the second magnetic pole of the magnetic device will substantially determine an axis of rotation for the stirring device when making the stirring movement, the generator coil, which is located asymmetrically with regard to this centre will be subject to a field resulting in the generation of electric energy by the generator coil. As, according to physical laws, a magnetic field is accompanied by an electrical field perpendicular to the magnetic field, the electric energy generated will be largely due to the electrical field, perpendicular to the magnetic field. The generator coil can be an asymmetrically positioned generator coil or an asymmetrically positioned part thereof. The part of the generator coil comprises one or more windings from a first tap, i.e. a first electrical terminal of the generator coil part, to a second tap, i.e. a second electrical terminal of the generator coil part. In case of a part of the generator coil which is asymmetrically positioned with regard to the centre, it is of course possible, but not required, that the generator coil as a whole is positioned symmetrically with regard to the centre.

Thus, it is possible that energy is coupled into the reception device by the first field.

By making use of two or more generator coils it is possible to increase efficiency, as the two or more generator coils, each providing for example an alternating electrical output signal, can e.g. be connected to a rectification circuit in a mutually phase inverted or phase shifted way, causing an alternate providing of electrical energy from the two generator coils to the rectification circuit.

Advantageously, the at least one generator coil or part thereof is connected to a rectification circuit for rectification of the generated electrical energy. Advantageously, the generator coil comprises a plurality of windings which have been wound around an axis extending from the first to the second pole of the magnetic device. As a result, the generator coil, and if present the second generator coil, will require only a small additional volume.

A further possible set-up is to position at least one stationary generator coil in the first field, for example in a pad which is to be placed under the vessel comprising the to be stirred substance. Thus, the at least one stationary generator coil does not make a stirring movement when the first field is active, but instead the stationary generator coil remains stationary with regard to the vessel. As the at least one stationary generator coil is subject to the first field, electrical energy will be generated by the generator coil. When the first field provides for a stepwise or continuous rotating movement of the stirring device, the at least one stationary generator coil can be located asymmetrically with regard to a centre of rotation of the rotating movement of the first field, which results in a high efficiency of energy transfer. However, a position of the stationary generator coil which is symmetrical to the first field is also possible. The at least one stationary generator coil is coupled, possibly via a rectification-, stabilisation- or other conditioning circuit, to a second field generation circuit. The second field generation circuit is also stationary and generates a second field, such as a high frequency RF field. The stirring device comprises a reception device for receiving energy which energy is provided by the second field. As a result, the reception device can have small dimensions, as the second field can be a high frequency field, enabling a use of various technologies in the reception device, which technologies are known as such. The reception device can for example comprise a small RF antenna, a crystal such as a piëzo-electrical crystal which resonates as a result of the second field being present, or a chip which comprises for example a resonance device or resonance circuit for receiving energy from the second field. The electrical energy generated by the reception device due to the second field can be stored in an electrical storage means, such as a capacitor and be used for powering the sensing device comprised in the stirring device. The stirring device can further comprise a buffering device for buffering (i.e. storing) measurement results obtained by the sensing device. Also it is possible that the measurement results are transmitted wirelessly, by a transmitting device comprised in the stirring device (such as in a manner as described above), to a receiver positioned outside of the substance to be stirred. The receiver can advantageously be powered by means of the at least one stationary generator coil, making a separate powering not required and can advantageously be located in a unit, such as a pad, in which the at least one stationary generator coil is located. Also it is possible that a data-logger for logging measurement results received by the receiver is located in the unit, such as the pad, in which the at least one stationary generator coil is located. Both the receiver as well as the data-logger can be located in the unit. Thus, the measurement system comprising the sensing device (which is comprised in the stirring device) and the unit comprising at least the stationary generator coil and the second field generation circuit, does not need any separate powering means as all electrical energy required is provided by the first field which is present for powering the stirring movement. The system can also be used in combination with powering devices according to the state of the art by placing the unit (such as the pad) in the first field near the vessel and using the stirring device according to the invention for stirring the substance. A further advantage is that energy can be also transferred by the second field to the reception device comprised in the stirring device when the stirring device does not make a stirring movement, as the transferral of energy to the stirring device is solely dependent on the second field and not on a local strength of the first field at the momentary position of the stirring device. Thus, also when the stirring device is brought out of its expected stirring movement, such as because of a collision of the stirring device with an object in the vessel or because of other error sources, causing a decrease in the local strength of the first field at the momentary position of the stirring device, measurements can still continue as energy can still be transferred to the stirring device by the second field.

BRIEF DESCRIPTION OF THE DRAWINGS

Further advantages of the invention will become clear from the appended drawing, showing a non-limiting embodiment of the invention, in which.

DETAILED DESCRIPTION OF THE PREFERRED EMBODIMENTS

Figure 1:
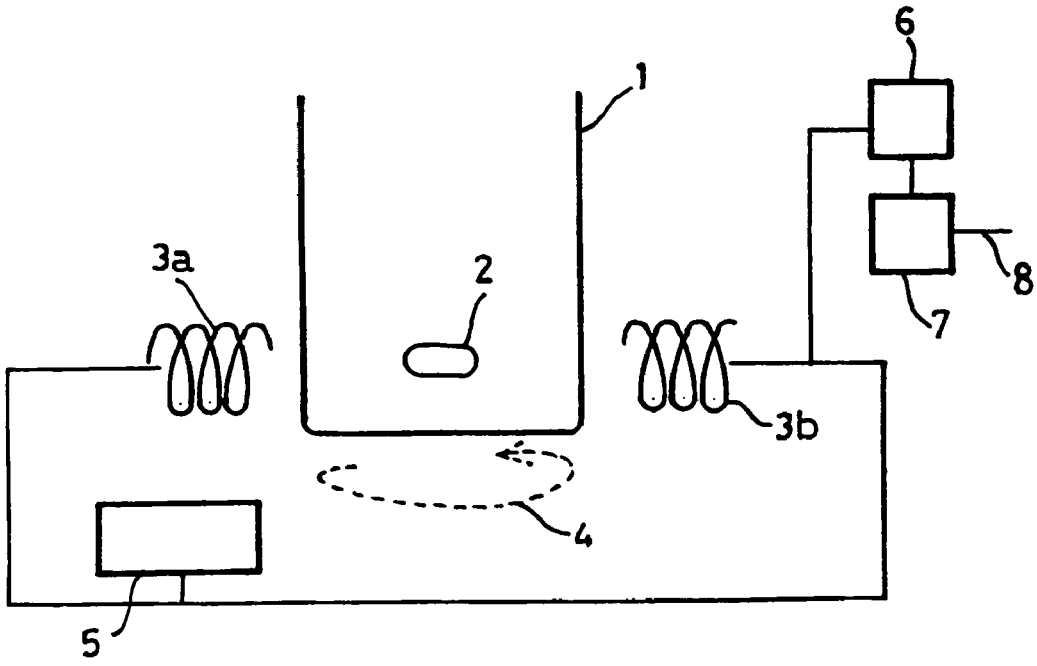
FIG. 1 shows a schematic side view of a stirrer according to the invention.

In the different Figures, identical reference numerals relate to identical components or components having similar functions.

FIG. 1 shows a vessel 1, for comprising a substance, which is not shown, and a stirring device 2, which is capsule-shaped or bean-shaped. The stirring movement of the stirring device is powered by a powering device, which comprises a number of coils, of which in FIG. 1 two coils 3*a*, 3*b* are shown. The coils 3*a*, 3*b* are driven with electrical current by an electronic driver unit 5, which rotates the polarity of the coils in phase, as for a electrical motor, resulting in a rotating magnetic field, which is schematically indicated by arrow 4. Additional coils, similar to the coils 3*a*, 3*b*, can be positioned around the vessel 1 in a circular or other appropriate way, and contribute to the rotating field indicated by the arrow 4. The stirring device 2 comprises a sensing device, in this case a temperature sensor, which is not shown in FIG. 1 but will be described in more detail below.

Further, FIG. 1 shows a transmitter unit 6, which drives the coils 3*a*, 3*b* with a second signal, resulting in a second electromagnetic field, which is applied to supply energy to the sensing device of the stirring device 2 and other components located inside the stirring device 2. Both the driver unit 5, and the transmitter unit 6 are coupled to the same coils 3*a*, 3*b*, which not only has the advantage that only one set of coils 3*a*, 3*b* is required, but also, that the driver unit 5 and the transmitter unit 6 can easily be synchronised. It will, however, be clear that the transmitter unit 6 may alternatively be coupled to one or more different coils or other field emitting elements not shown in detail in FIG. 1. By coupling the driver unit 5 and the transmitter unit 6 to the same coils 3*a*, 3*b*, and synchronising the driver unit 5 and the transmitter unit 6, it is possible to adapt the second field such that a significant part of the energy of the second field is supplied by the respective coil 3*a*, 3*b* which is geometrically in the most optimum location relative to the momentary location of stirring device 2 in the vessel 1. As the location of the stirring device 2 is largely determined by the respective polarities of the coils 3*a*, 3*b*, this effect can easily be achieved by a synchronisation of the driver unit 5 and the transmitter unit 6, as will be appreciated and can easily be implemented by a person skilled in the art.

Figure 2A:
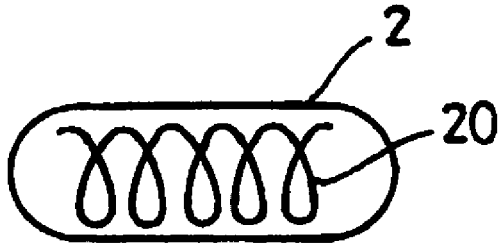
FIGS. 2*a* and 2*b* each show a schematic cross-sectional view of a stirring device according to the invention.
Figure 2B:
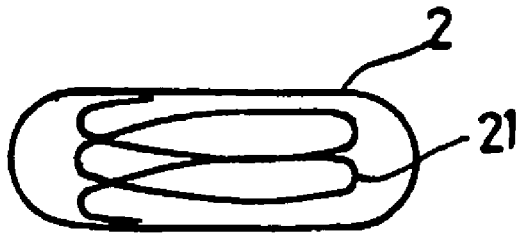

The stirring device 2, which performs e.g. temperature measurements, comprises a coil 20, wound around a longitudinal axis of the stirring device 2 as depicted in FIG. 2*a*. Alternatively, it is possible that the stirring device 2 comprises a coil 21 wound around a transverse axis of the stirring device 2, as depicted in FIG. 2*b*.

Figure 3:
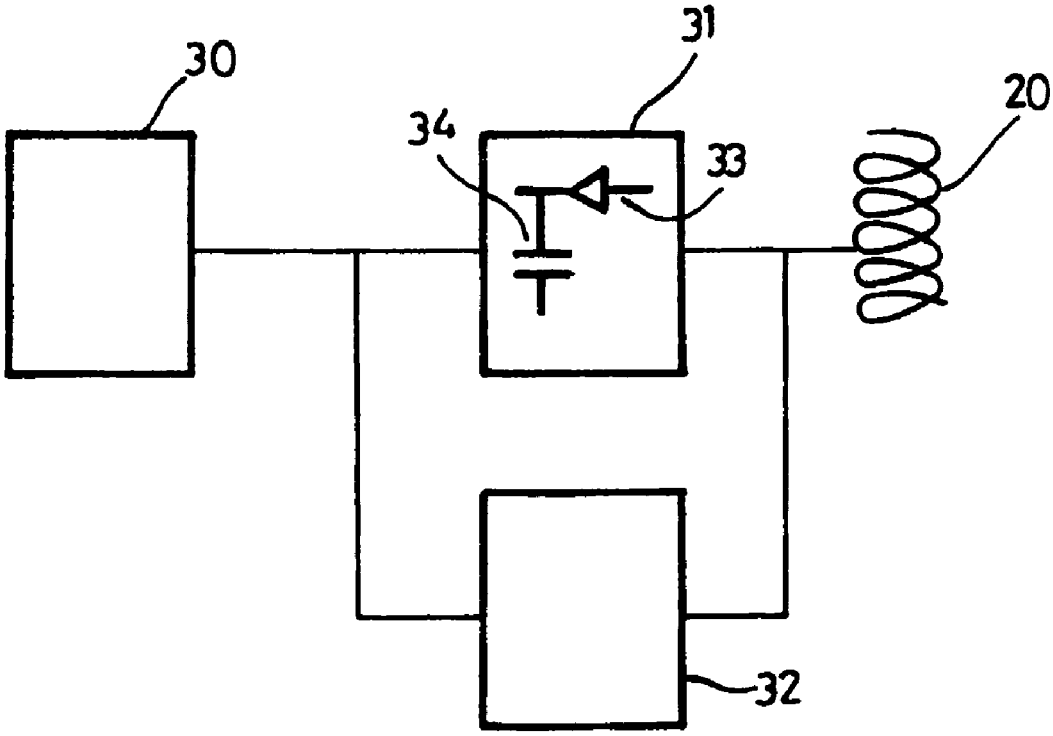
FIG. 3 shows a block diagram of circuitry of a stirring device according to the invention.

Further, as illustrated in FIG. 3, the stirring device comprises a sensing device 30, in this example comprising a silicon integrated circuit (IC) temperature sensor, a reception device 31 and a transmitting device 32. The reception device 31 is coupled to the coil 20, and converts the electrical energy received by the coil 20, which is induced by the second field, into a direct current (DC) voltage, using rectification means, such a silicon diode 33, and filtering means, such as a capacitor 34. The DC voltage is applied as a supply voltage to supply the sensing device 30, as well as the transmitting device 32 with electrical energy, the reception device 31 being coupled to both the sensing device 30 as well as the transmitting device 32. The sensing device 30 is coupled to the transmitting device 32 for transmitting the measurement results. Therefore, the transmitting device 32 again is coupled to the coil 20, for e.g. modulating the impedance of a current loop in which the coil 20 is comprised, as will be known to a person skilled in the art. The changes in the impedance are detected in the transmitter unit 6, shown in FIG. 1, and evaluated by receiver means comprised therein. The resulting measurement data are sent from the transmitting unit 6 to a read-out device 7, which is supplied with an external interface 8 for displaying the measurement data on e.g. an electronic display, or storing and processing the measurement data in a computer.

Figure 4:
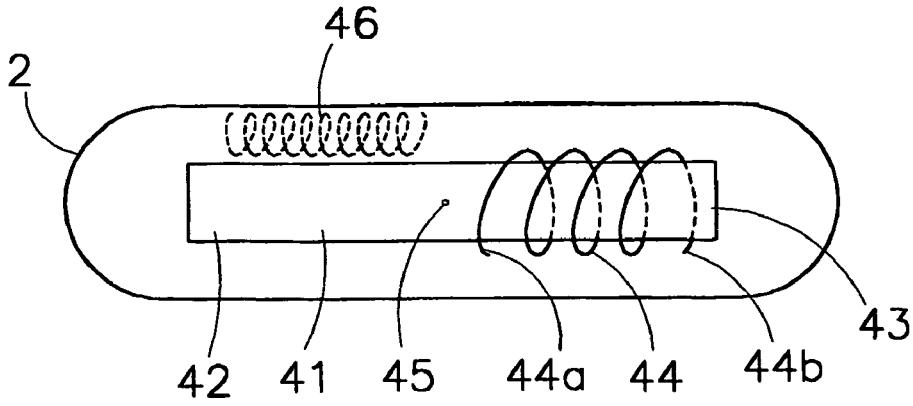
FIG. 4 shows a highly schematic, cross-sectional view of another embodiment of a stirring device according to the invention.

FIG. 4 shows a top or side view of another embodiment of a stirring device 2. The stirring device 2 comprises a magnetic device 41, such as a permanent magnet, comprising a first magnetic pole 42 and a second, opposite magnetic pole 43. For generating electrical energy, such as a voltage or a current in the stirring device 2, the stirring device 2 comprises a generator coil 44 which is wound around the magnetic device 41. The generator coil 44 is positioned asymmetrically with regard to a centre 45 of the magnetic device, the centre being in between the first magnetic pole 42 and the second magnetic pole 43. Alternatively to the position of the generator coil 44 shown, in FIG. 4, it is of course also possible that the generator coil in positioned in another location, such as for example indicated by the generator coil 46 which is indicated by a dashed line. Further, it will be clear that the generator coil 44, or generator coil 46 (or generator coil part) which is comprised in the reception device, is connected to further circuitry, such as a rectification-, filtering- or stabilisation circuit.

Figure 5:
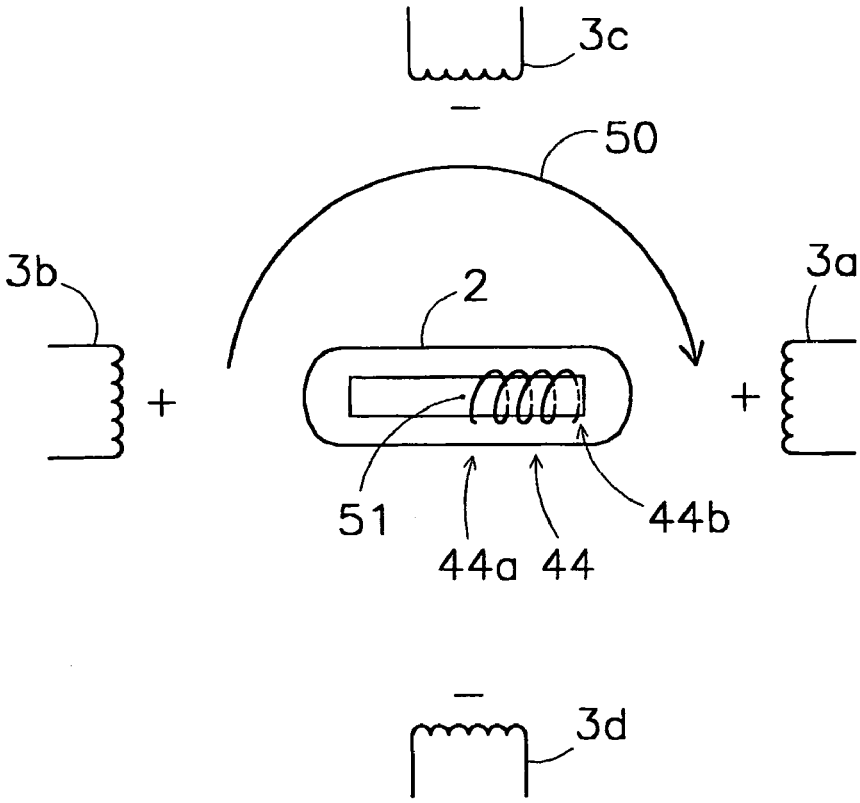
FIG. 5 shows a highly schematic view of a stirrer comprising the stirring device according to FIG. 4.

As explained in FIG. 5, the stirring device 2 will make a stirring movement, powered by a plurality of electro magnets of which respective coils 3*a*, 3*b*, 3*c*, 3*d* are shown. By simultaneously of consecutively driving the coils 3*a*, 3*b*, 3*c*, 3*d* in a sequential or repetitive way with positive and/or negative currents, an alternating electromagnetic field will be generated, which causes the stirring device 2 to make a stirring movement, such as a rotating movement as indicated by the arrow 50. It will be understood that the terms positive and negative currents refer to currents which are flowing in the coils 3*a*, 3*b*, 3*c*, 3*d* and which can be of forward respectively reversed polarity resulting in magnetic fields with alternating polarity, such as indicated in FIG. 5 by the signs + and −, respectively. Thereby, the stirring device 2 will rotate around an axis of rotation, indicated by 51. Normally, the axis 51 will substantially coincide to the centre 45 to cause a smooth, substantially vibration free rotation of the stirring device. Thus, as the generator coil 44 is positioned asymmetrically with regard to an axis indicated in FIG. 5 by 51, the first end 44*a* of the generator coil 44 will virtually experience no changes in the first field during rotation of the stirring device 2, as the first end 44*a* is located relatively close to the centre of rotation, indicated by 51. A second end 44*b* of the generator coil 44 is located relatively remote from the centre of rotation 51. Therefor, the second end 44*b* of the generator coil 44, will, during rotation, experience a larger change in the field than the first end 44*a* of the generator coil 44.

Figure 6A:
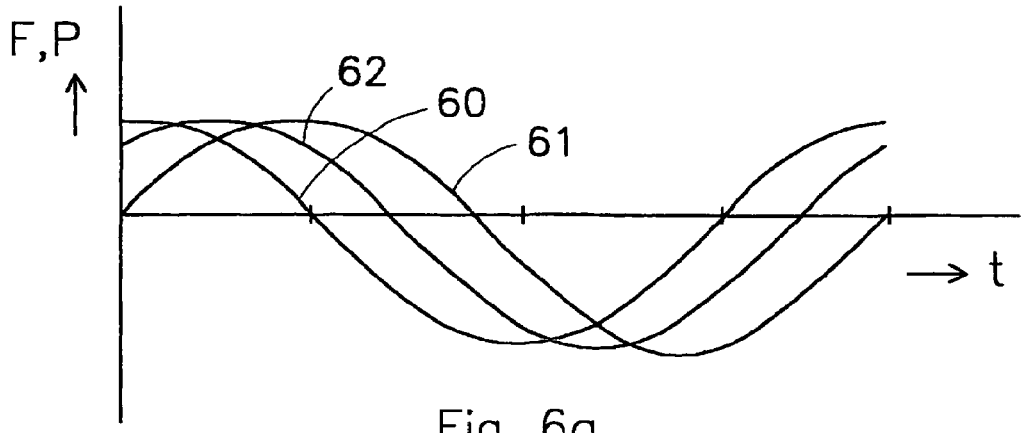
FIGS. 6*a* and 6*b* show graphical representations of magnetic and electrical fields generated in a stirring device according to the invention.
Figure 6B:
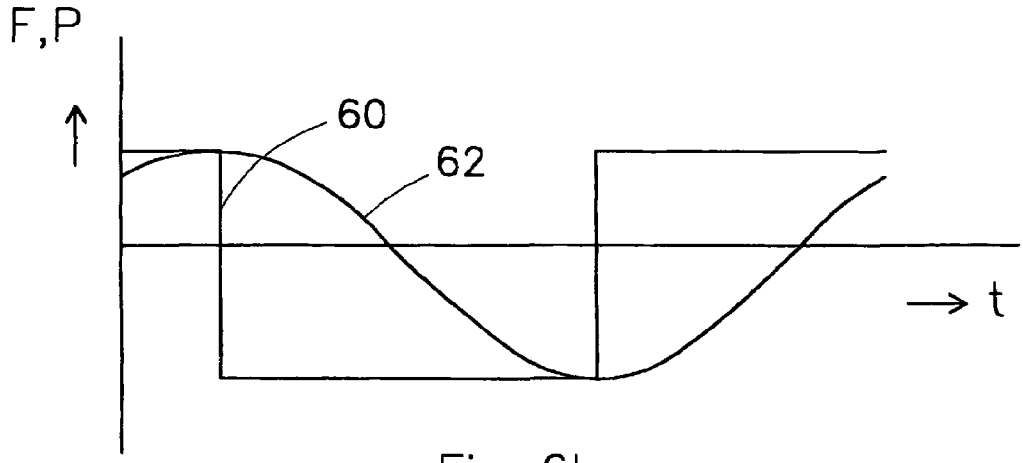

The first field is an electro magnetic field, comprising a magnetic field as well as an electrical field which is perpendicular to the magnetic field. As indicated in FIGS. 6*a* and 6*b* respectively, which each show a graph of field (F) and position. (P) on the vertical axis against a time (t) on the horizontal axis, the magnetic field 60 and the electrical field 61 will make a rotating movement in case of a rotating field as depicted in FIG. 6*a*, or will make an alternating movement, such as a 'switched' movement, as indicated in FIG. 6*b*. In either case, the stirring device, powered by the magnetic field, will perform a rotating movement, which follows the magnetic field 60, and which is indicated in FIGS. 6*a* and 6*b* by 62. In the generator coil 44, an electrical quantity, such as an electrical voltage or an electrical current will now be generated, as a result of the fluctuations in electrical and magnetic field to which the generator coil 44, and in particular the second end 44*b* thereof, is subject. It is believed that the generation of the electrical quantity in the generator coil 44 by the first field is especially due to the changes in electric field which occur when the stirring device 2 makes the rotating, stirring movement powered by the first field.

The electrical quantity, which is expected to have an alternating magnitude, can be rectified for generating a DC voltage, such as for powering the sensing device (not shown in FIG. 4 and FIG. 5) which is comprised in the stirring device 2. For improved efficiency, it is also possible to install a second generator coil in the stirring device 2, which is also located asymmetrically with regard to a centre 45, enabling to improve efficiency as the generator coil 44 and the second generator coil can be connected to a rectification means in a phase shifted manner, causing an alternate contribution of electrical energy from the generator coil 44 and the second generator coil, in a manner which will be known by a person skilled in the art. The generator coil 44 and the second generator coil can both be located on the same side of the magnetic device, i.e. can both be located between the centre 45, and the second pole 43, however it is also possible that the second generator coil is located on an opposite side of the centre 45, such as between the centre 45 and the first magnetic pole 42. The generator coil 44 can, for optimum space efficiency, be located around the magnetic device 41, thus windings of the generator coil 44 are effectively wound around the magnetic device 41. It will be understood that the term "wound" is not only to be interpreted as to imply that the generator coil 44 is manufactured by winding the windings thereof around the magnetic device 41, but it is also possible that the generator coil 44 is fabricated, i.e. the windings of the generator coil 44 are wound first, and after that the generator coil 44 is installed in a position around the magnetic device 41, as described and shown in FIGS. 4 and 5.

Figure 7:
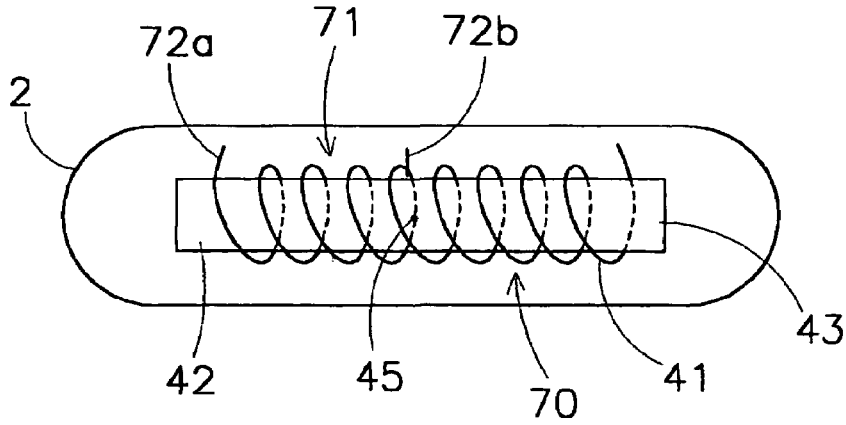
FIG. 7 shows a highly schematic, cross-sectional view of an other alternative embodiment of the stirring device according to the invention.

Alternative to the stirrers shown in FIGS. 4 and 5, many variations with asymmetrically positioned coil or part thereof are possible. By way of example, FIG. 7 shows a stirring device 2 comprising a magnetic device 41 and a generator coil 70. The generator coil 70 is positioned substantially symmetrically with regard to the centre 45 between the opposite magnetic poles 42, 43 of the magnetic device. The generator coil 70 comprises a generator coil part 71 with terminals 72*a* and 72*b*, the generator coil part being positioned asymmetrically with regard to the centre 45.

Thus, with the set-up shown in FIG. 4-6 it is possible to generate an electrical quantity in the stirring device, without the need for generating an additional field in the stirrer, as the first field, which is already generated for powering the stirring movement of the stirring device, is applied for generating the electrical quantity making use of the generator coil.

Figure 8:
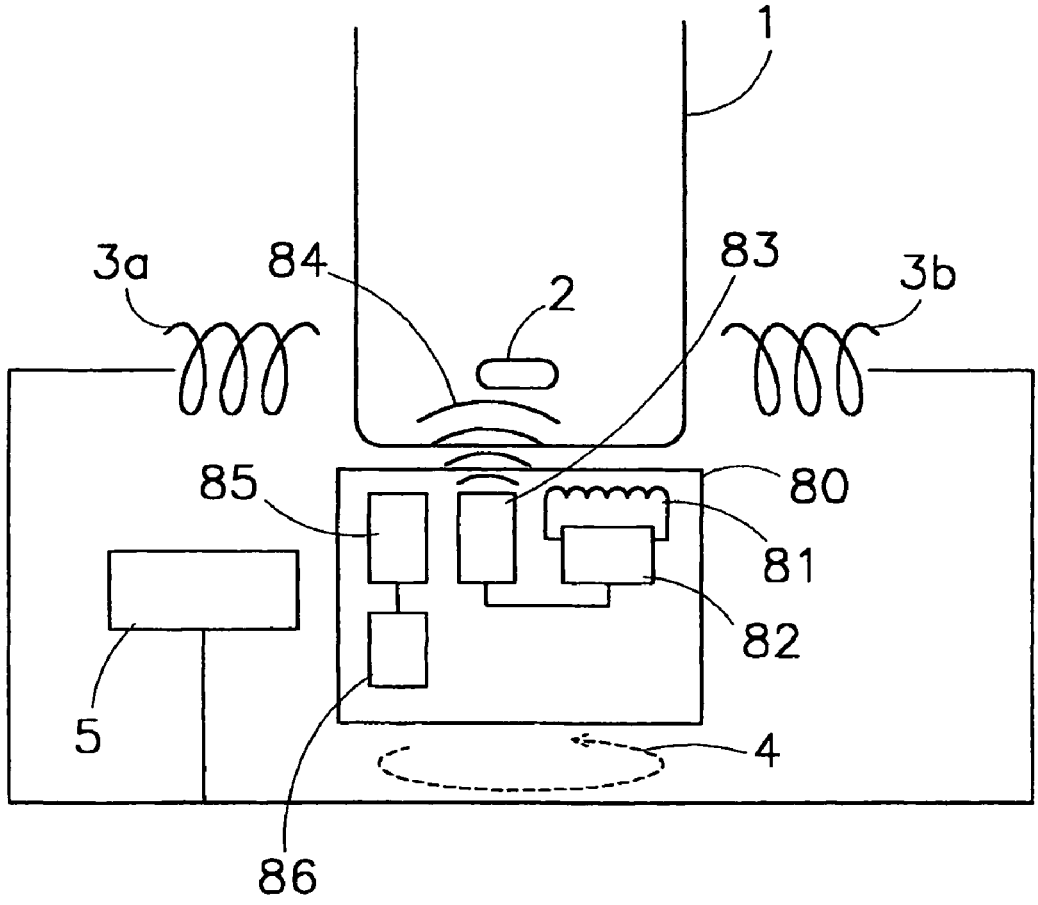
FIG. 8 shows a schematic side view of an other embodiment of the stirrer according to the invention.

FIG. 8 shows a vessel 1, stirring device 2, coils 3*a* and 3*b*, an arrow 4 representing a stirring movement and an electronic driver unit 5, the functions of which have been explained above. Further, FIG. 8 shows a unit, such as a pad 80 which can be positioned under the vessel 1. The pad can have a flat shape for placement under the vessel, but has been depicted thicker in the figure for the sake of clarity and readability. The pad 80 comprises a stationary generator coil 81 for generating electrical energy from the first field. The stationary generator coil 81 does not make a stirring movement when the first field is active, but instead the stationary generator coil remains stationary with regard to the vessel 1. The first field provides for a stepwise or continuous rotating movement of the stirring device 2, indicated by the arrow 4, and the at least one stationary generator coil 81 is located asymmetrically with regard to a centre of rotation of the rotating movement of the first field, which results in a high efficiency of energy transfer. However, a position of the stationary generator coil 81 which is symmetrical with regard to the first field is also possible. The stationary generator coil 8 is coupled to a rectification circuit 82, for generating a DC supply voltage. Further, the pad 80 comprises a second field generation circuit 83, coupled to the rectification circuit 82, for generating a second field indicated by 84, which is an RF field. The second field is received by a reception device, in the stirrer 2, and converted into electrical energy. The reception device in this example comprises an RF coil as functioning as an RF antenna, but alternatively a crystal such as a piëzo-electrical crystal which resonates as a result of the second field being present, or a chip which comprises for example a resonance device or resonance circuit for receiving energy from the second field is also possible. The stirring device 2 further comprises a rectification circuit for rectification of the electrical energy received by the reception device and a sensing device which is connected to the rectification circuit and receives electrical energy thereof. The electrical energy generated by the reception device due to the second field is stored in an electrical storage means, in this case a capacitor (not shown) and be used for powering the sensing device. The stirring device further comprises a buffering device (not show), connected to the sensing device, for buffering measurement results obtained by the sensing device and a transmitting device, coupled to the sensing device and/or the buffering device for transmitting measurement results to a receiver 85 comprised in the pad 80. The receiver 85 is powered from the rectification circuit 82 in the pad 80, making a separate powering not required. Further, a data-logger 86 for logging measurement results received by the receiver is located in the pad 80. Thus, the pad 80 and the stirring device 2 do not need any separate powering means as all electrical energy required is derived from the first field which is present for powering the stirring movement.

The invention claimed is:

1. A stirrer for stirring a substance, the stirrer comprising a stirring device and a powering device, the stirring device being adapted to be submerged in the substance for making a stirring movement, the powering device by a first field contactiessly applying a force onto the stirring device for powering the stirring movement of the stirring device, wherein the stirring device comprises a sensing device for measuring at least one parameter of the substance, including a reception device, coupled to the sensing device, for remote coupling of energy into the reception device and an electromagnetic device and wherein the reception device comprises at least one generator coil or part thereof for generating electrical energy, the generator coil or part thereof comprising respective terminals being positioned asymmetrically with regard to a centre between a first magnetic pole and an opposite, second magnetic pole of the magnetic device.

2. The stirrer according to claim 1, wherein the at least one parameter of the substance comprises a temperature and the sensing device comprises a temperature sensor.

3. The stirrer according to claim 2, wherein the temperature sensor comprises an integrated circuit sensor.

4. The stirrer according to claim 2, wherein the temperature sensor comprises a resistor having a temperature dependent resistance.

5. The stirrer according to claim 2, wherein the temperature sensor comprises a resonance device having at least one temperature dependent resonance parameter.

6. The stirrer according to claim 1, wherein the at least one parameter of the substance comprises an acidity or a viscosity.

7. The stirrer according to claim 1, wherein the first field is a magnetic or electromagnetic field and the stirring device comprises a magnetic device.

8. The stirrer according to claim 7, wherein the powering device comprises a rotating magnet and the first field is a rotating field.

9. The stirrer according to claim 7, wherein the powering device comprises a plurality of electromagnets which are supplied with electrical current for creating a stirring movement in the stirring device.

10. The stirrer according to claim 1, wherein the stirring device comprises a reception device, coupled to the sensing device, for remote coupling of energy into the reception device.

11. The stirrer according to claim 10, wherein the remote coupling of energy is provided by a second field.

12. The stirrer according to claim 11, wherein the second field is an electromagnetic field and the coupling is an inductive coupling.

13. The stirrer according to claim 12, wherein the reception device comprises a reception coil.

14. The stirrer according to claim 13, wherein the coil is wound around a longitudinal or transverse axis of the stirring device.

15. The stirrer according to claim 13, wherein the transmitting coil is the reception coil, and wherein the transmitting device comprises a transmitting coil.

16. The stirrer according to claim 15, wherein the transmitting device modulates an impedance of the transmitting coil.

17. The stirrer according to claim 15, wherein the reception device comprises a detection device, for detecting if power is received momentarily, and the transmitting device is enabled to transmit at least a measurement when the detection device detects that no energy is received momentarily.

18. The stirrer according to any of claims 11, wherein the electromagnetic field has a frequency in the range of 1 to 100 kHz.

19. The stirrer according to claim 1, wherein the stirring device comprises a transmitting device, coupled to the sensing device for transmitting at least one measurement from the stirring device to a receiver positioned outside the substance to be stirred.

20. The stirrer according to claim 19, wherein the transmitting device comprises a transmitting coil.

21. The stirrer according to claim 1, wherein the measuring of the at least one parameter is performed repeatedly.

22. The stirrer according to claim 21, wherein the time interval between successive measurements is essentially constant.

23. The stirrer according to claim 1, wherein the stirring device has a maximum dimension of 10 mm.

24. The stirrer according to claim 1, wherein the stirring device is disk-, capsule- or longitudinally shaped.

25. The stirrer according to claim 1, wherein the stirring device comprises an encapsulation comprising glass, epoxy or PTFE.

26. A stirring device for use in a stirrer according to claim 1, the stirring device comprising a sensing device for measuring at least a parameter of the substance including a reception device, coupled to the sensing device, for remote coupling of energy into the reception device and an electromagnetic device and wherein the reception device comprises at least one generator coil or part thereof for generating electrical energy, the generator coil or part thereof comprising respective terminals being positioned asymmetrically with regard to a centre between a first magnetic pole and an opposite, second magnetic pole of the magnetic device.

27. A stirring apparatus comprising a stirrer according to claim 1, and a container or vessel for comprising the substance.

28. The stirring apparatus according to claim 27, comprising a receiver device comprising receiver means for receiving measurement data transmitted by the stirring device and readout means for transmitting the measurement data to a readout device.

29. The stirrer according to claim 1, wherein energy is coupled into the reception device by the first field.

30. The stirrer according to claim 1, wherein the at least one generator coil is connected to a rectification circuit for rectification of the generated electrical energy.

31. The stirrer according to claim 1, wherein the at least one generator coil or part thereof comprises a plurality of windings which have been wound around an axis extending from the first to the second pole of the magnetic device.

* * * * *